US005701147A

United States Patent [19]

Nozawa

[11] Patent Number: 5,701,147

[45] Date of Patent: Dec. 23, 1997

[54] INK JET HEAD AND INK JET APPARATUS USING SAME

[75] Inventor: Minoru Nozawa, Machida, Japan

[73] Assignee: Canon Kabishiki Kaisha, Tokyo, Japan

[21] Appl. No.: 648,400

[22] Filed: May 15, 1996

Related U.S. Application Data

[63] Continuation of Ser. No. 114,395, Sep. 1, 1993, abandoned.

[30] Foreign Application Priority Data

Sep. 1, 1992 [JP] Japan ..... 4-233772

[51] Int. Cl.[6] ..... B41J 2/05

[52] U.S. Cl. ..... 347/58

[58] Field of Search ..... 347/58, 55, 57, 347/56, 42, 30, 41, 74, 65

[56] References Cited

U.S. PATENT DOCUMENTS

| | | | |
|---|---|---|---|
| 4,313,129 | 1/1982 | Hara | 386/2 |
| 4,345,262 | 8/1982 | Shirato et al. | 347/57 |
| 4,376,945 | 3/1983 | Hara et al. | 347/67 |
| 4,459,600 | 7/1984 | Sato et al. | 347/56 |
| 4,463,359 | 7/1984 | Ayata et al. | 347/42 |
| 4,558,333 | 12/1985 | Sugitani et al. | 347/65 |
| 4,723,129 | 2/1988 | Endo et al. | 347/74 |
| 4,740,796 | 4/1988 | Endo et al. | 347/56 |
| 4,947,191 | 8/1990 | Nozawa et al. | 347/30 |
| 4,999,646 | 3/1991 | Trask | 347/41 |
| 5,006,867 | 4/1991 | Koizumi et al. | 347/42 |
| 5,126,768 | 6/1992 | Nozawa et al. | 347/65 |

FOREIGN PATENT DOCUMENTS

| | | |
|---|---|---|
| 0289347 | 11/1988 | European Pat. Off. . |
| 0344809 | 12/1989 | European Pat. Off. . |
| 0435699 | 7/1991 | European Pat. Off. . |
| 0457557 | 11/1991 | European Pat. Off. . |
| 2843064 | 4/1979 | Germany . |
| 54-51837 | 4/1979 | Japan . |
| 54-56847 | 5/1979 | Japan . |
| 59-123670 | 7/1984 | Japan . |
| 59-138461 | 8/1984 | Japan . |
| 60-71260 | 4/1985 | Japan . |
| 61-79669 | 4/1986 | Japan . |
| 62-264961 | 11/1987 | Japan . |

*Primary Examiner*—Benjamin R. Fuller
*Assistant Examiner*—Raquel Yvette Gordon
*Attorney, Agent, or Firm*—Fitzpatrick, Cella, Harper & Scinto

[57] ABSTRACT

An ink jet recording head includes a first substrate having energy generating elements for generating energy for ejecting liquid; a second substrate connected with the first substrate; discrete electrodes electrically connected with the energy generating elements, respectively; and a common electrode electrically connected with the energy generating elements; wherein the discrete electrodes are on the first substrate, and the common electrode is on the second substrate.

6 Claims, 6 Drawing Sheets

INK JET HEAD AND INK JET APPARATUS USING SAME

This application is a continuation of application Ser. No. 08/114,395 filed Sep. 1, 1993 abandoned.

FIELD OF THE INVENTION AND RELATED ART

The present invention relates to an ink jet head and ink jet apparatus using the same, usable with an ink jet recording system.

An ink jet recording apparatus is recently particularly noted because the noise produced by the printing operation is negligibly small, a high speed recording is possible, and plain paper is usable without the necessity of image fixing.

Among them, the ink jet recording process disclosed in Japanese Laid-Open Patent Application No. 51837/1979 and German Laid-Open Patent Application (DOLS) 2843064, is advantageous over the other liquid jet recording system. The recording process is characterized by thermal energy is applied to liquid to eject the liquid.

In the recording process disclosed in the above, the recording liquid receiving the thermal energy causes change of state including rapid volume increase, which ejects the liquid through the ejection outlet at an end of the recording head. By this, a droplet of ink is ejected onto a recording material. The ink jet recording process disclosed in the German Laid-Open Patent Application No. 2843064 is advantageous since it is used with a drop-on demand system, that the recording head can be arranged at high density An a full-line type recording head. Therefore, a high resolution, a high quality print can be produced at high speed.

As for the method of using the high density multi-orifice recording head to the best advantage, a stationary type full-line recording head is considered, which is operable without scanning the recording head if the recording material is smaller than A4 size sheet.

A typical example of such recording head is shown in FIGS. 1 and 2. FIG. 1 is a general perspective view of the recording head, and FIG. 2 is an enlarged perspective view of the part around the ejection outlets.

The recording head has 3328 ejection outlets 14 cover a width 208 mm of A4 size sheet at a density of 16 per mm.

It comprises a heater board 1 Si or the like. On top of that, there are provided electrothermal transducers having ejection energy generating elements 15 corresponding to the ejection outlets and electrode lines for supplying electric energy thereto (not shown). The full-multi recording head further comprises a top plate 2 of glass, metal or the like. It is provided with recesses, formed by cutting, etching or the like to provide ink inlet 9 for receiving recording liquid such as ink and a common liquid chamber in communication with respective ink passages to contain the ink to be supplied to the ink passages.

Each of the ink passages is formed in a solid layer corresponding to ejection energy generating element of a heater board 1. The top plate 2 is bonded to the solid material layer. The heater board 1 is securedly bonded on the base plate 5. Electric connection pads of the heater board 1 are aligned with pads of a flexible plate 3, and are electrically connected with the apparatus. FIGS. 7 and 8 show two examples of structures of conventional heat generating resistors and electrodes in a recording head.

In these Figures, designated by reference numerals 101, 102 and 103 are heat generating resistor, discrete electrode and common electrode. If an attempt is made to form on the same substrate nozzles covering 208 mm the density of 16 nozzles per 1 mm, the number of nozzles is 208×16 is 3328. In addition, the same number of electrothermal transducers 101 and electrodes are found at the respective sides thereof. Since the discrete electrodes 102 and the common electrodes 103 are produced by the same film forming process, the sheet resistance is $0.07\Omega/cm^2$ for an Al film of $5000\times10^{-7}$ mm thick.

When the electrodes are formed as shown in FIG. 7, and when the high density wiring is made, the width per one electrode thermal transducer is approx. 60 mm, and therefore, the width of the discrete electrode 102 is small with the result of the wiring resistance of not less than 100Ω and therefore a large electric loss. Additionally, a high manufacturing technique is required to uniformly form the Al film without defect over 208 mm.

Then, in order to assure the width of the discrete electrode, it may be possible that the structure shown in FIG. 8 is employed. Although the wiring resistance of the electrode structure shown in FIG. 8 is one half that of FIG. 7, but the common electrode 103 has a small thickness and as wide as 208 mm, and therefore, the potential gradient occur if the resistance at the opposite ends are not sufficiently small. Since the electrodes are formed by thin film forming process, it is desired that the area of the electrode is large, but doing so is difficult from the structure of the nozzle.

Japanese Laid-Open Patent Application No. 264961/1987 discloses that in order to assure the area of the common electrodes, a common electrode is extended to the backside of the base plate having the formed electrothermal transducers. However, this requires that the thin films are formed on both sides of the base plate, and therefore, the manufacturing step becomes complicated. In addition, the reliability of the electrode is not so high. Particularly the problem is remarkable in the area where the electrodes are arranged.

In order to accomplish high density multi-orifice structure with the conventional construction, the problem arises that the wiring resistance or the electric gradient is large due to the wiring arrangement of the electrodes.

SUMMARY OF THE INVENTION

Accordingly, it is a principal object of the present invention to provide an ink jet recording head and an ink jet recording apparatus having the ink jet recording head in which the wiring resistance or the potential gradient is minimized, while accomplishing a high density for multi-nozzles can be provided.

According to an aspect of the present invention, there is provided an ink jet recording head comprising: a first substrate having energy generating elements for generating energy for ejecting liquid; a second substrate connected with the first substrate; discrete electrodes electrically connected with the energy generating elements, respectively; and a common electrode electrically connected with the energy generating elements; wherein the discrete electrodes are on the first substrate, and the common electrode is on the second substrate.

According to this aspect, one of the electrodes connected to the heat generating resistors is a discrete electrode, and the other is a common electrode. Therefore, it is possible to maintain the equivalent electrode density on the first substrate as the density of the heat generating resistors. Therefore, the width of the discrete electrodes can be large, and the wiring resistance is remarkably reduced.

In addition one of the electrodes connected to the heat generating resistors is first common electrode, and a second common electrode connected substantially electrically uniformly to the first common electrode through a plurality of connecting members, is provided over a wide range of the second substrate, and therefore, the potential gradient from the second common electrode to the respective heat generating resistors is small.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 9:
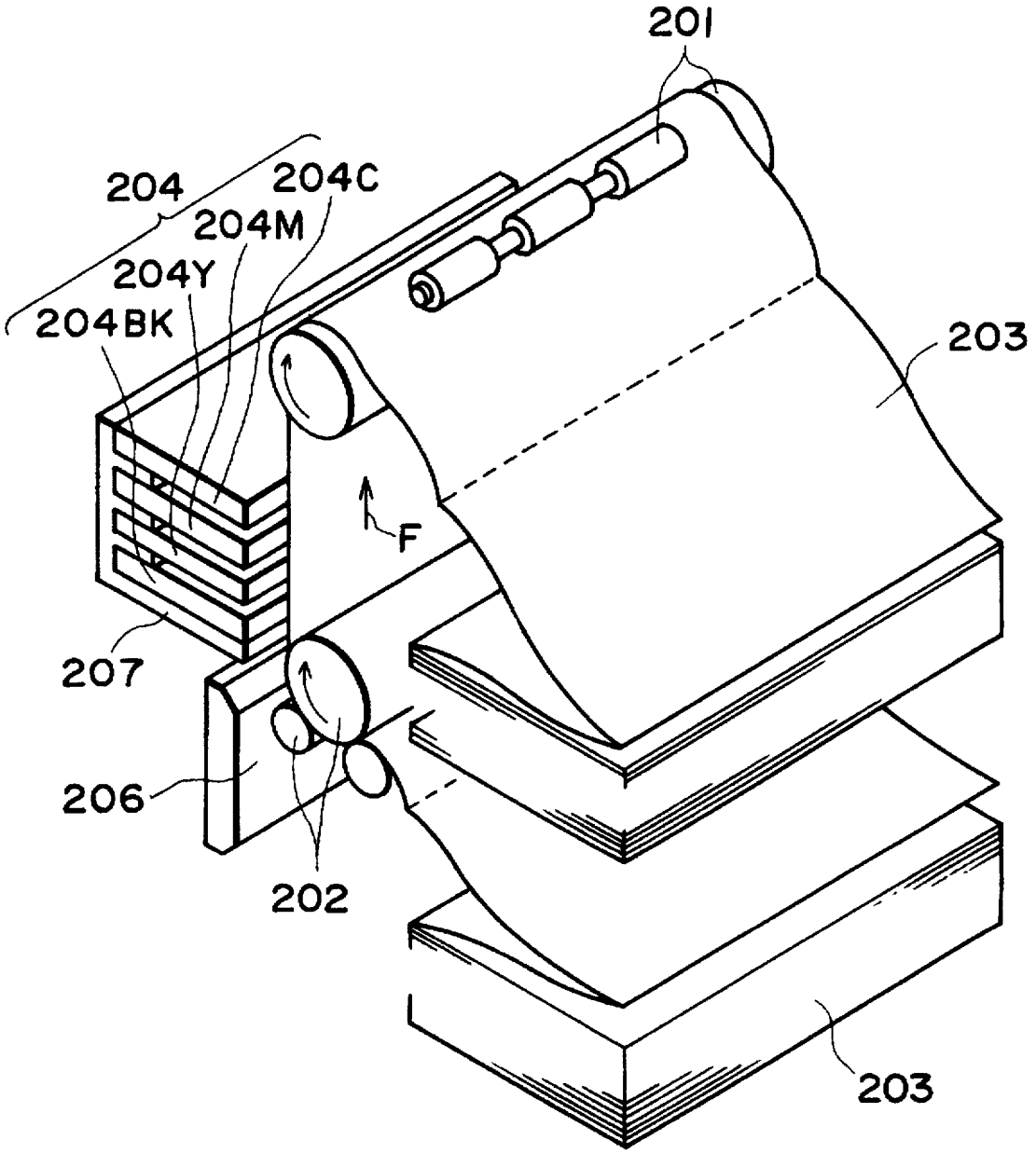
FIG. 9 is a perspective view of an ink jet recording apparatus having an ink jet recording head according to an embodiment of the present invention.
Figure 10:
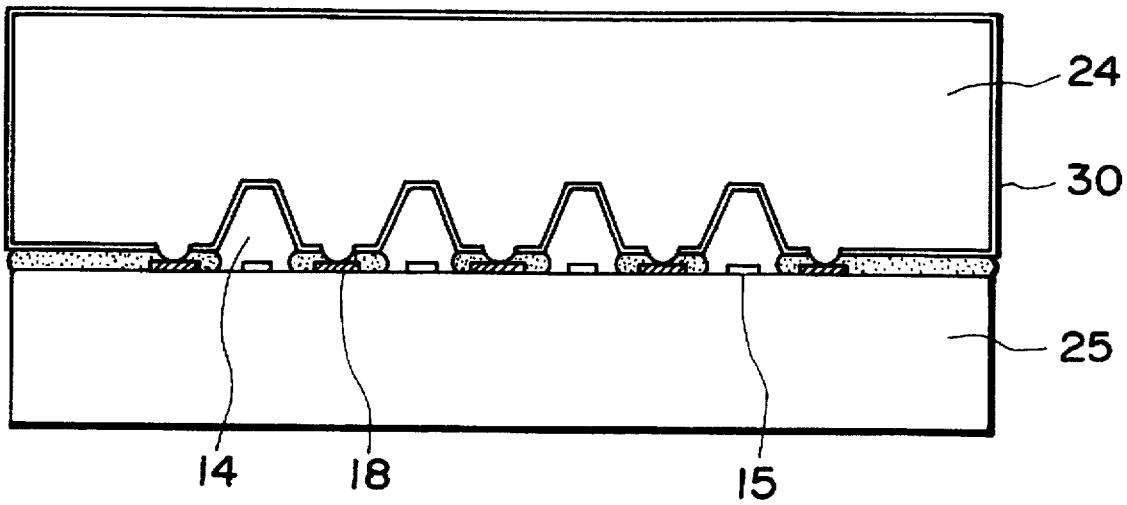
FIG. 10 is a sectional view of an ink jet recording head according to a further embodiment of the present invention.
Figure 11:
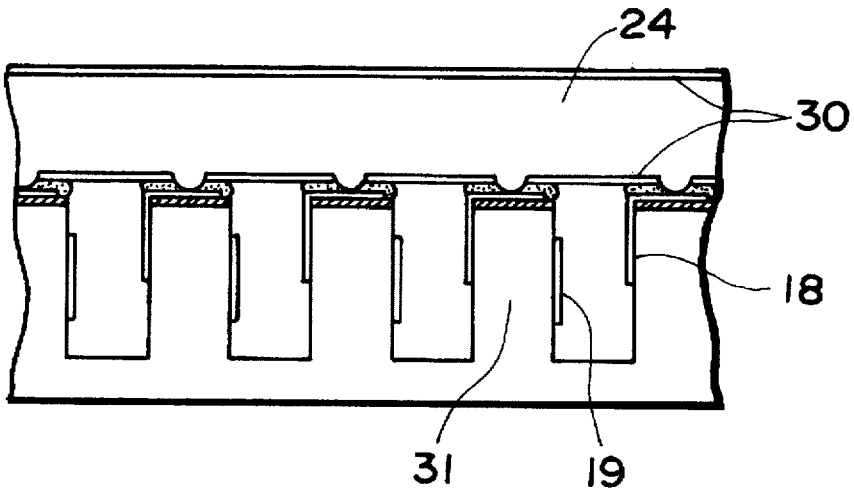
FIG. 11 is a sectional view of an ink jet recording head according to a further embodiment of the present invention.

Referring to the accompanying drawings, the description will be made as to Embodiments of the present invention. Referring to FIG. 9, the general arrangement of an ink jet recording apparatus will be described. In this Figure, an ink jet recording apparatus is shown which comprises a plurality of (four) ink jet recording heads of a line type, capable of forming a full-color image. In FIG. 9, a pair of rollers 201 and 202 function to feed a recording material such as a sheet of paper or plastic material in a direction, of sub-scan (feeding direction) indicated by an arrow F. Designated by 204B, 204Y, 204M and 204C, are ink jet recording heads (ink jet recording means) of a full multi nozzle type having ejection outlets in a range covering substantially the entire width of the recording material 204. In the following descriptions, the recording head (recording means) will be referred to as recording head 204, when any one or all of the recording heads are designated.

As for the colors of the ink ejected from the recording heads 204 are black, yellow, magenta and cyan in the case of full-color recording. In the shown example, four ink jet recording heads 204 are disposed in this order from the upstream side (from the bottom in the Figure) with respect to the feeding direction of the recording material. A recovery system 206 for recovering from an improper ink ejection of the recording head 204 is provided, and is moved to between the recording head 204 and the recording material 203 upon the ejection recovery operation (process), so that the recovery system 206 is faced to the recording head 204 to effect the recording head recovery operation. Each of the ink jet recording heads 204 is mounted to a head mount 207 with correct relative relationship therebetween. Thus, the ink jet recording head of this invention comprises head mounts 207 for mounting thereon the ink jet recording heads 204, feeding means 201 and 202 for feeding the recording material 203 to the recording positions of the recording heads 204 on the recording head mounts 207.

The description will be made as to the ink jet recording head 201.

Figure 1:
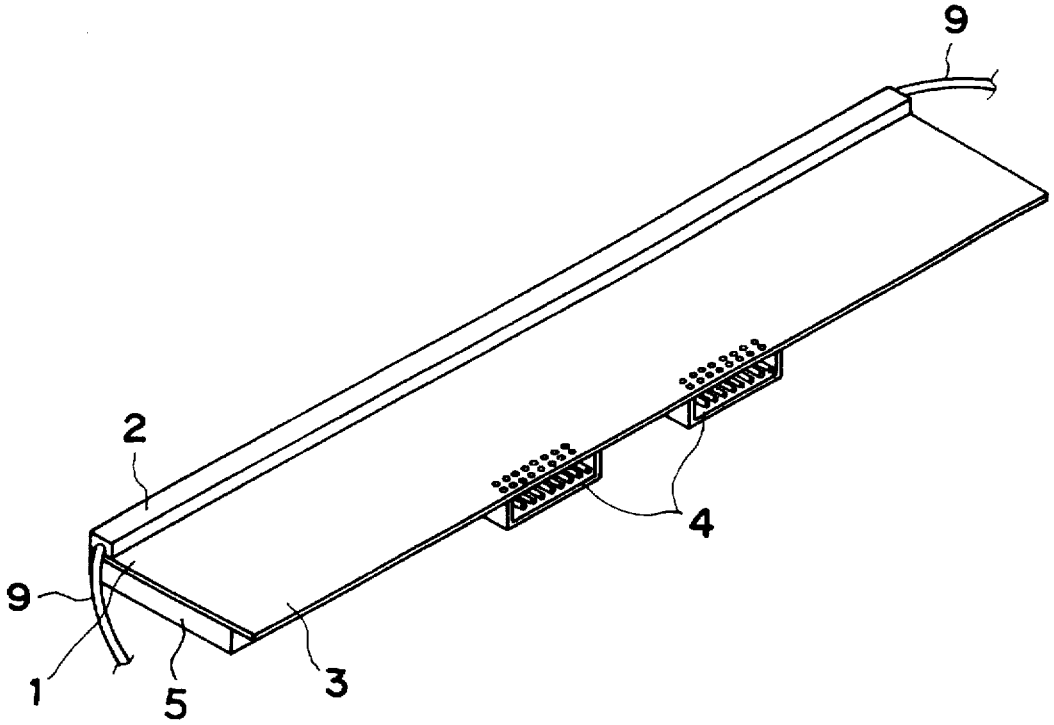
FIG. 1 is a perspective view of an ink jet recording head of known type, which recording head can be used with an embodiment of the present invention.
Figure 2:
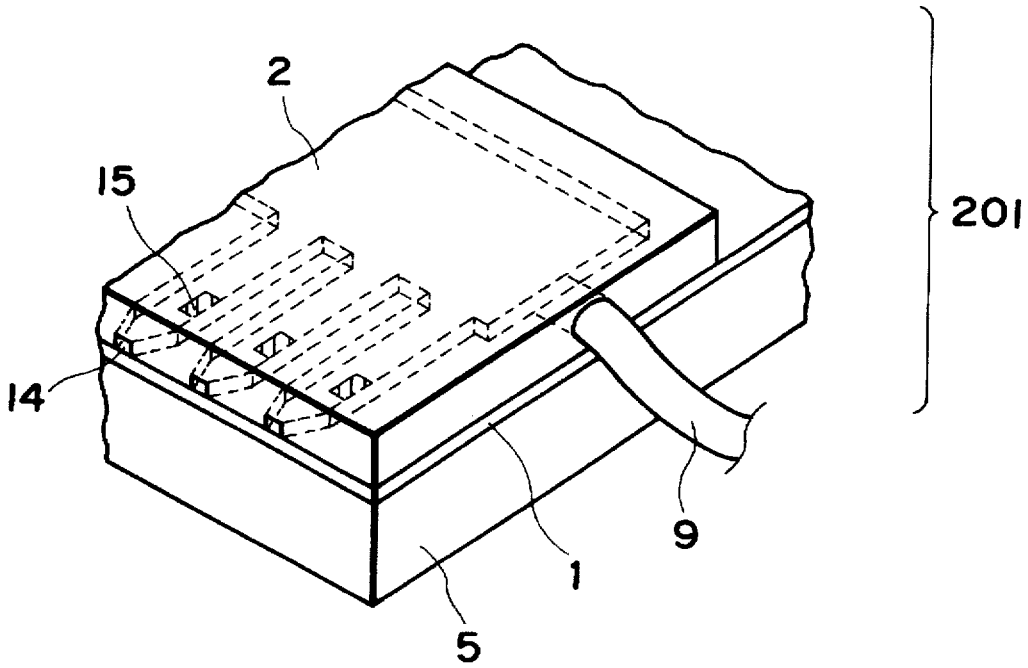
FIG. 2 is an enlarged perspective view of a region adjacent the ejection outlets of the known type of ink jet recording head shown in FIG. 1, which also can be used with an embodiment of the present invention.

As shown in FIG. 2, the ink jet recording head 201 is provided, for each liquid passage, with an electrothermal transducer 15 for generating thermal energy upon voltage application thereto to eject the recording liquid through the associated ejection outlets 14. The plural ejection outlets 14 are arranged in a line. By application of driving signal, the electrothermal transducer 15 generates thermal energy to cause film boiling in the ink in the liquid passage to create a bubble. By the expansion of the bubble, the ink droplet is ejected through the ejection outlet 14.

Figure 3:
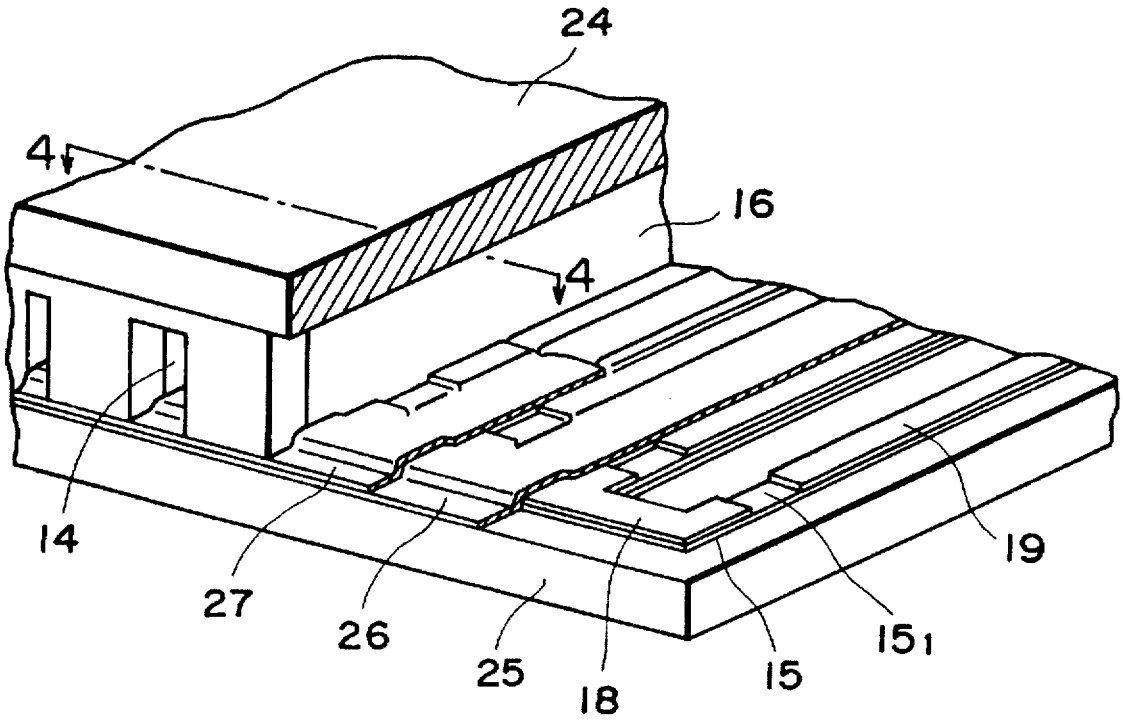
FIG. 3 is a detailed perspective view of an ink jet recording head according to an embodiment of the present invention.
Figure 4:
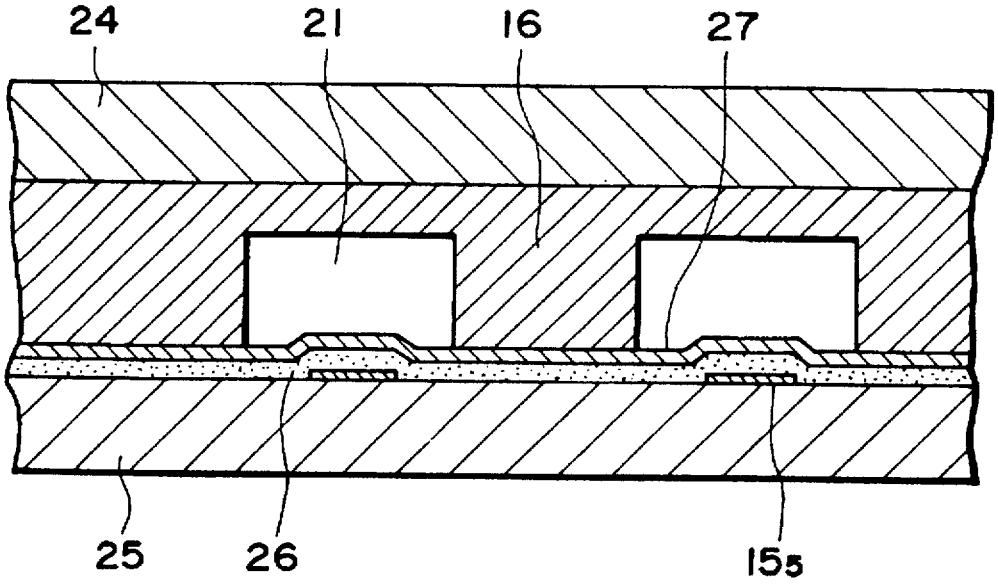
FIG. 4 is a sectional view taken along a line 4–4' in FIG. 3.

FIG. 3 is a partly broken perspective view of an ink jet recording head according to an embodiment of the present invention. FIG. 4 is a sectional view taken along a line A—A of FIG. 3. In FIGS. 3 and 4, a plurality of connecting members and a protection film on a second substrate are not shown for the sake of simplicity, and will be described hereinafter.

As shown in FIGS. 3 and 4, on one side of a first substrate 25 of glass or silicon wafer, there are energy generating means in the form of electrothermal transducers 15. It has a configuration like a comb. On one side of the electrothermal transducer 15, discrete electrodes 19 are laminated in the manner that a part thereof is omitted to expose the electrothermal transducer 15. On one side of the electrothermal transducer 15, a first common electrode 18 connected to the discrete electrode 19 is laminated. The parts exposing the electrothermal transducer 15 function as heat generating resistors $15_1$. On one side of a first base plate 25, a protection layer 26 of insulating oxide is laminated. On the surface of the protection layer 26, a metal film 27 is laminated to cover the area from an end adjacent the ejection outlets 14 to the electrothermal transducer 15 for the purpose of increasing the resistance against cavitation.

Above the first substrate 25, there is a second substrate 24 disposed in parallel with the first substrate 25. A nozzle forming member 16 is sandwiched between the first and second substrates 25 and 24 to cover the area of projected metal film 27. The nozzle forming member 16 is disposed so that the space corresponding to each of the heat generating resistors $15_1$ between the adjacent nozzle walls.

The description will be made as to the ejection of the ink through the ejection outlets. The ink supplied to and contained in the liquid chamber not shown. The ink enters the liquid passage 21 by capillary force to fill the liquid passage with meniscus at the ejection outlet 14. When the electric energy is supplied to the heat generating resistor $15_1$ through the discrete electrode 19 and a first common electrode 18, so that heat is generated. The ink is rapidly heated above the heat generating resistor $15_1$, so that a bubble is formed in the liquid passage 21. By the expansion of the bubble, the ink is ejected through the ejection outlet 14.

Figure 5:
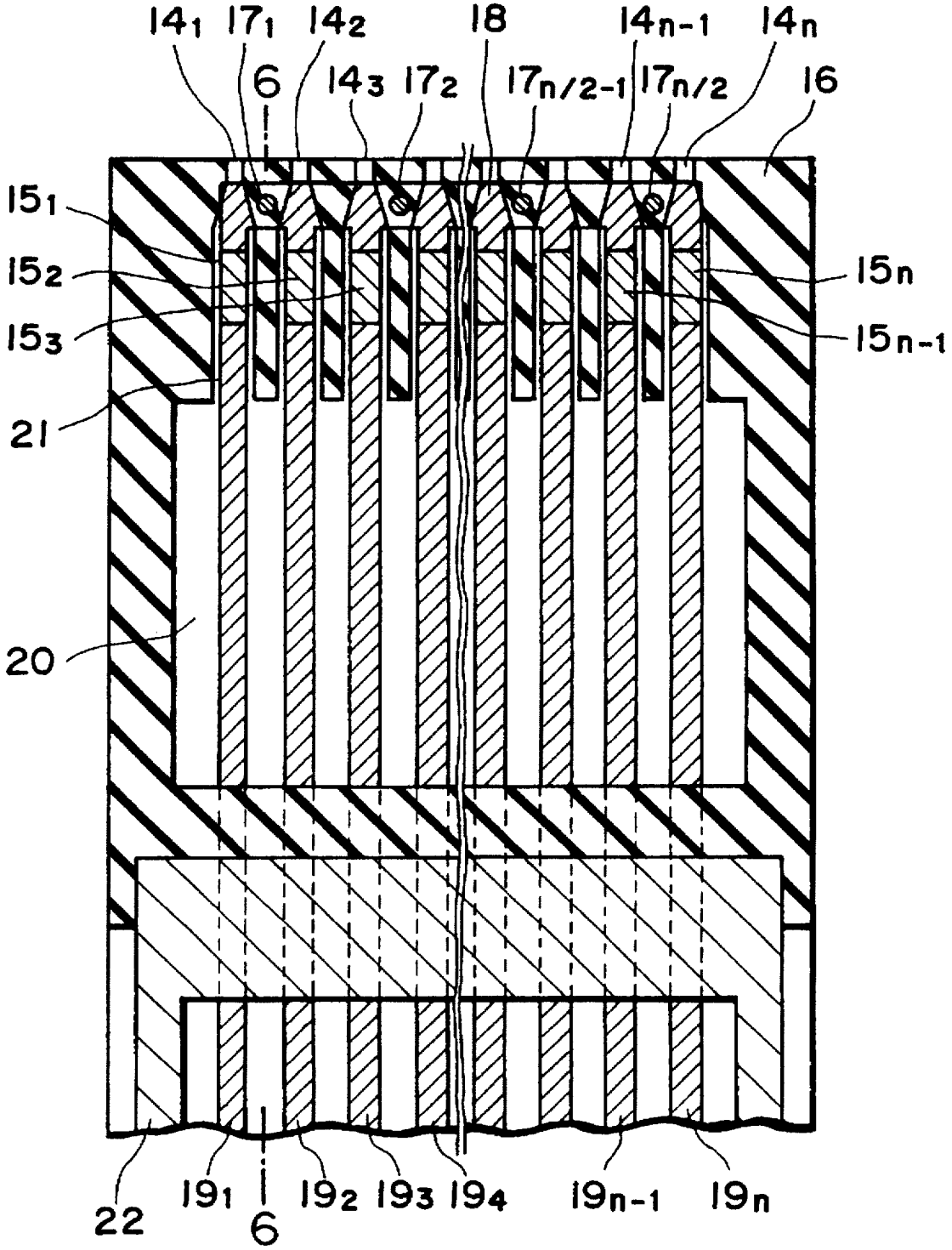
FIG. 5 is a sectional view of an ink jet recording head of FIG. 2 (5–5' cross-section in FIG. 6)

The description will be made as to the ink jet recording head according to this embodiment. FIG. 5 is a sectional view of the ink jet recording head, and FIG. 6 is a sectional view taken along a line B—B (FIG. 6 is a sectional view taken along a line C—C).

Figure 6:
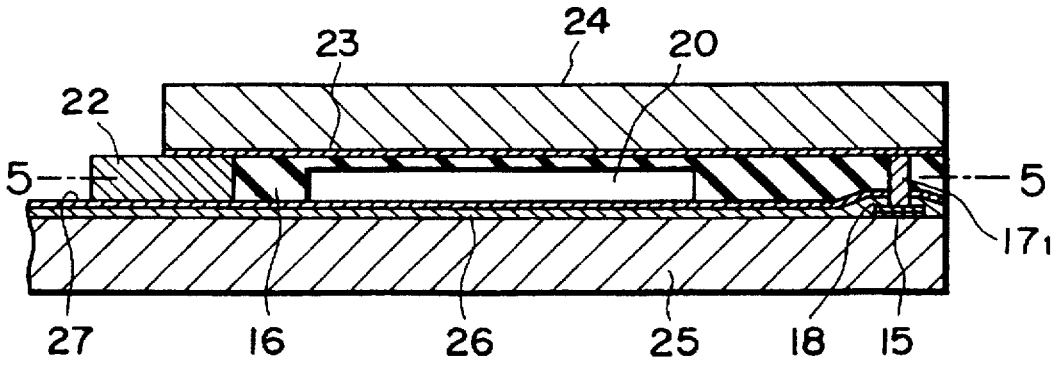
FIG. 6 is a sectional view taken along a line 6–6' of FIG. 5.
Figure 7:
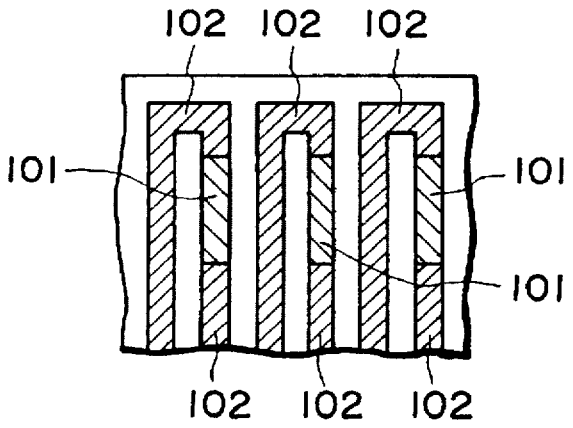
FIG. 7 PRIOR ART
FIG. 7 illustrates a structure of a heat generating resistor and an electrode in a conventional ink jet recording head.
Figure 8:
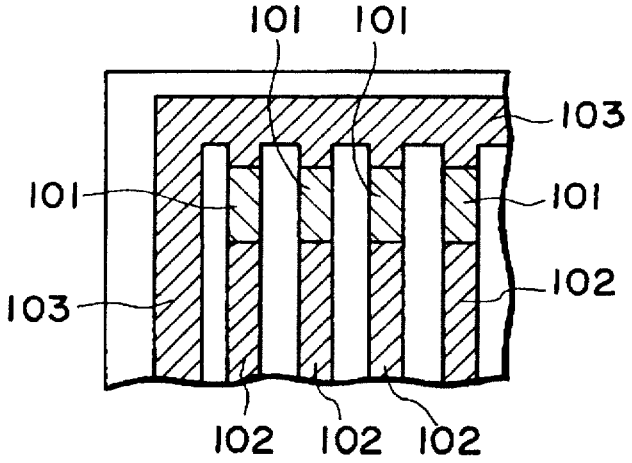
FIG. 8 PRIOR ART
FIG. 8 illustrates a structure of a heat generating resistor and electrode in another conventional ink jet recording head.

As shown in FIGS. 5 and 6, heat generating resistors $15_1$–$15_n$ are arranged at predetermined intervals on the first substrate 25. The heat generating resistor is a part of the electrothermal transducer 15. On the electrothermal transducers 15, there are provided discrete electrodes $19_1$–$19_n$ of Al for supplying electric signals independently to the plurality of heat generating resistors $15_1$–$15_n$, and a first common electrode 18 of Al commonly connected to the heat generating resistors $15_1$–$15_n$. A portion of the first common electrode 18 other than the portion for connection with a plurality of connecting members $17_1$–$17_{n/2}$, is electrically isolated from the recording liquid by protection layer 26 of $SiO_2$ or polyimide or the like. The nozzle forming member 16 functions to form a plurality of liquid passages, a plurality of ejection outlets $14_1$–$14_n$, and a common liquid chamber 20 in communication with the liquid passages. It is preferable that the nozzle forming member 16 is of electric insulating material such as resin. For the entire surface of the second substrates (top plate) 24 which is faced to the first substrate 25, there is provided a second common electrode 23 of aluminum or the like. The second common electrode 23 is electrically connected with the first common electrode 18 by a plurality of connecting members $17_1$–$17_{n/2}$ disposed at regular intervals and made of high conductivity material. In this embodiment, a third common electrodes 22 is electrically connected with the second common electrode 23, the third common electrode 22 having been formed by the same method as for the plurality of connecting members $17_1$–$17_{n/2}$. By doing so, the connection between the third electrode 22 and the driver (not shown) of a driver IC or print board or the like, can be accomplished easily by wiring bonding or the like. The third electrode 22 and the plurality of discrete electrodes $19_1$–$19_n$ are electrically isolated by the protection layer 26.

The description will by made as to the manufacturing method of the above-described ink jet recording head.

In order to form the recording head on the same substrate with 16 nozzles per 1 mm over a width of 208 mm (width of an A4 size sheet), a plurality of heat generating resistors $15_1$–$15_n$ of $HfB_2$ are formed on the first substrate 25 through film forming process and photolithographic etching process, and a plurality of discrete electrodes $19_1$–$19_n$ of Al and the first common electrode 18 are formed on the electrothermal transducer 15 through the same process. Thereafter, the protection layer 26 of $SiO_2$ is formed over the entire area of the first substrate 25 including the discrete electrodes $19_1$–$19_n$ and the first common electrode 18, through the film forming process or photolithographic etching system. Here, the portion where the connecting members $17_1$–$17_{n/2}$ and terminal portions (not shown) of the discrete electrode $19_1$–$19_n$ are not covered with the protection layer 26.

Through a plating process, a connecting member $17_1$–$17_{n/2}$ of Al having a height of several tens microns approximately, are formed on the common electrode 18. On the first substrate 25, a positive polarity resist liquid which will constitute the liquid chamber 20 and the plurality of liquid passages 21 is applied by spinner or roll coater, and it is patterned through a photolithographic process, so that a nozzle forming member 16 having the common liquid chamber 20 and the plurality of liquid passages 21, is formed. Here, it is preferable that the thickness of the positive polarity liquid resist is lower than the height of the plurality of connecting members $17_1$–$17_{n/2}$.

Subsequently, the second substrate 24 having formed second common electrode 23 and third common electrode 22, and the first substrate 25 are laminated. Thereafter, curable resin is injected to between the first substrate 25 and the nozzle forming member 16, and the resin is cured. By the curing and contraction of the resin material, the compression joint is established between the plurality of connecting members $17_1$–$17_{n/2}$ and the second common electrode 23 and between the second common electrode 23 and the third common electrode 22. In the ink jet recording head of this embodiment, the liquid passage 21 does not communicate with the second substrate 24 by the nozzle forming member 16, and therefore, there is no need of forming the protection layer at the second substrate 24 side.

With the above-described structure, there is provided the third common electrode 22, and therefore, it is possible to reduce the density of the discrete electrodes $19_1$–$19_n$ and the unshown drivers can be reduced to the half of the conventional example. In addition, the first common electrode 18 is substantially short-circuited with the second common electrode 23 extending widely on the second substrate 24 through the plurality of connecting members $17_1$–$17_{n/2}$, and therefore, the wiring resistance can be reduced very much, so that the problem of the potential gradient is eliminated.

The second substrate itself may be made of electrically conductive material. In this case, an insulating film may be formed on the surface of the second substrate through dipping process or the like, and the portion in contact with the third electrode and the plurality of connecting members are deprived of the insulating film by photolithographic etching process.

In the case of ultraviolet curing resin being used as the nozzle forming material, the second substrate is preferably made of transparent material such as glass. As for the second electrode, a transparent electrode is preferable, and the suitable materials are $In_2O_3/SiO_2$, $Bi_2O_3/Au/Bi_2O_3$ or the like.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals.

By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion.

The present invention is applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

As regards the kinds and numbers of the recording heads loaded in the apparatus, may be plural, corresponding to the recording colors or densities.

The ink jet recording apparatus may be used as an output terminal of an information processing apparatus such as computer or the like, as a copying apparatus combined with an image reader or the like, or as a facsimile machine having information sending and receiving functions, While the invention has been described with reference to the structures disclosed herein, it is not confined to the details set forth and this application is intended to cover such modifications or changes as may come within the purposes of the improvements or the scope of the following claims.

What is claimed is:

1. An ink jet recording head comprising:

a first substrate having energy generating elements for generating energy for ejecting a liquid;

a second substrate connected with said first substrate, said second substrate having a plurality of grooves cooperable with said first substrate so as to define a plurality of ink passages;

a plurality of discrete electrodes electrically connected with said energy generating elements, respectively; and a common electrode electrically connected with said energy generating elements, wherein said discrete electrodes are disposed on said first substrate, and said common electrode is disposed on said second substrate.

2. An ink jet recording head according to claim 1, wherein said second substrate is of an electroconductive material, and said second substrate functions as a second common electrode.

3. An ink jet recording head according to claim 2, wherein said second substrate is coated with non-electroconductive material in an area other than an area electrically connected with said energy generating elements.

4. An ink jet recording head according to claim 1 or 2, in which said energy generating elements are in a form of electrothermal transducers.

5. An ink jet recording apparatus having an ink jet recording head according to claim 1.

6. A manufacturing method for forming an ink jet recording head, comprising the steps of:

preparing a first substrate having energy generating elements for generating energy for ejecting liquid;

preparing a second substrate which is connected with said first substrate to constitute a liquid passage;

providing said first substrate with discrete electrode electrically connected with said energy generating elements;

providing said second substrate with a common electrode electrically connected with said energy generating elements.

* * * * *

UNITED STATES PATENT AND TRADEMARK OFFICE

CERTIFICATE OF CORRECTION

PATENT NO. : 5,701,147
DATED : December 23, 1997
INVENTOR(S) : Minoru Nozawa

It is certified that error appears in the above-identified patent and that said Letters Patent is hereby corrected as shown below:

Column 1,
Line 20, "by" should read -- in that --.
Line 31, "that" should read -- so that --; and "An" should read -- in a --.
Line 32, "resolution," should read -- resolution and --.
Line 43, "cover" should read -- which cover --.
Line 45, "Si" should read -- of Si --.
Line 57, "element" should -- elements --.
Line 67, "heat" should read -- the heat --.

Column 2,
Line 11, "60 mm," should read -- 60 μm, --.
Line 22, "occur" should read -- occurs --.
Line 26, "from" should read -- due to --.
Line 67, "first" should read -- a first --.

Column 3,
Line 60, "material 204." should read -- material 203. --

Column 4,
Line 12, "204," should read -- 204 and --.
Line 30, "line A—A" should read -- 4—4' --
Line 61, "chamber" should read -- chamber is --.
Line 63, "meniscus" should read -- a meniscus --.
Line 65, "so" should be deleted.
Line 66, "that" should be deleted.

Column 5,
Line 6, "line B—B" should read -- line 6—6' --.
Line 7, "line C—C)." should read -- line 5—5,). --.
Line 32, "electrodes 22" should read -- electrode 22 --.
Line 42, "by" should read -- be --.
Line 57, "electrode" should read -- electrodes --.
Line 60, "connecting member" should read -- plurality of connecting members --.

Column 6,
Line 9, "the compression" should read -- a compression --.
Line 31, "dipping" should read -- a dipping --.

UNITED STATES PATENT AND TRADEMARK OFFICE

CERTIFICATE OF CORRECTION

PATENT NO. : 5,701,147
DATED : December 23, 1997
INVENTOR(S) : Minoru Nozawa

It is certified that error appears in the above-identified patent and that said Letters Patent is hereby corrected as shown below:

Column 7,
Line 17, "head" (second occurrence) should read -- heads --.
Line 55, "is" (first occurrence) should read -- in --.

Column 8,
Line 10, "may" should read -- they may --.
Line 57, "electrode" should read -- electrodes --.
Line 59, "ments;" should read -- ments; and --.

Signed and Sealed this

Fourth Day of December, 2001

*Attest:*

Nicholas P. Godici

*Attesting Officer*

NICHOLAS P. GODICI
*Acting Director of the United States Patent and Trademark Office*